United States Patent [19]

Schmöller et al.

[11] 4,351,486

[45] Sep. 28, 1982

[54] PROCESS AND A GRINDING STONE FOR PREPARING MECHANICAL WOOD PULP

[75] Inventors: Karl-Heinz Schmöller, Haar; Theodor Bähr, Heidenheim; Ernst Böttger, Herbrechtingen-Eselsburg; Hans-Otto Henrich, Heidenheim; Helmut Thumm, Heidenheim; Heinz Beck, Heidenheim, all of Fed. Rep. of Germany

[73] Assignees: J. M. Voith GmbH, Heidenheim; Dyckerhoff & Widman AG, Munich, both of Fed. Rep. of Germany

[21] Appl. No.: 101,285

[22] Filed: Dec. 7, 1979

[30] Foreign Application Priority Data

Dec. 13, 1978 [DE] Fed. Rep. of Germany ..... 2853716
Feb. 20, 1979 [DE] Fed. Rep. of Germany ..... 2906449

[51] Int. Cl.[3] ..... B02C 19/00

[52] U.S. Cl. ..... 241/67; 241/280; 241/294

[58] Field of Search ..... 241/21, 23, 28, 43, 241/66, 67, 277, 280, 281, 282, 294

[56] References Cited

U.S. PATENT DOCUMENTS 1,619,004 3/1927 Sternkopf ..... 241/28 X
2,887,276 5/1959 Minarik ..... 241/67
2,929,568 3/1960 Vawter ..... 241/67
3,734,419 5/1973 Cryderman ..... 241/282
3,973,737 8/1976 Thorsell ..... 241/294

FOREIGN PATENT DOCUMENTS 511547 10/1930 Fed. Rep. of Germany .

*Primary Examiner*—Howard N. Goldberg
*Attorney, Agent, or Firm*—Ostrolenk, Faber, Gerb & Soffen

[57] ABSTRACT

The disclosure concerns a process for grinding wood on a grinding stone and the grinding stone which grinds the wood. The grinding stone has a central core, which may be comprised of concrete or steel. The core has a free inner space. A water supply line extends along the free inner space. Outlets from the water supply line are directed toward the periphery of the core at the grinding zone of the grinding layer. Around the core is a grinding layer for grinding the wood. The grinding layer is permeable so that water can be transmitted through it. The permeability may arise from the porosity of the material of the grinding layer itself or through the provision of bores or gaps in the grinding layer. The grinding layer may be comprised of a group of segments covering the core and the gaps may be defined between segments. The core may have bores for delivering the water to the inside of the grinding layer. The water may be heated and/or pressurized for improving grinding.

25 Claims, 11 Drawing Figures

Fig. 7
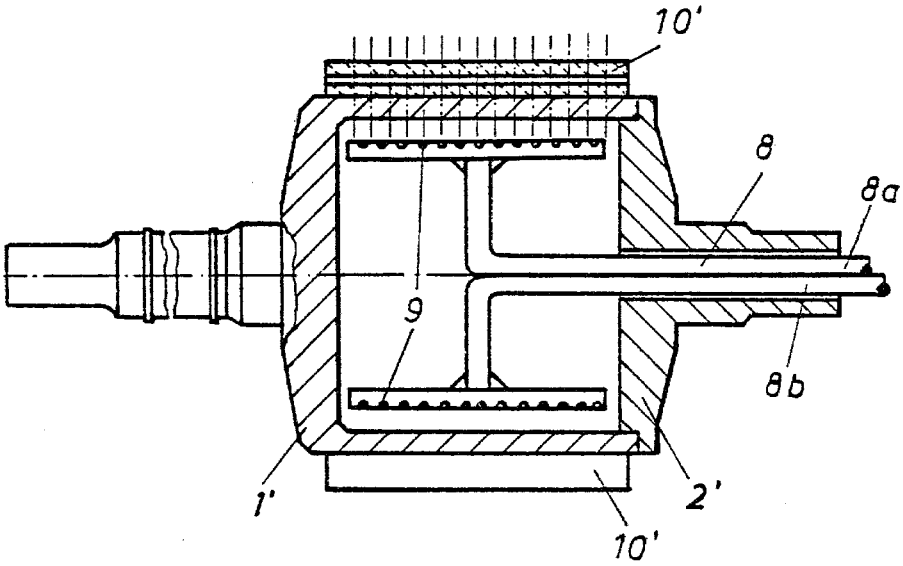
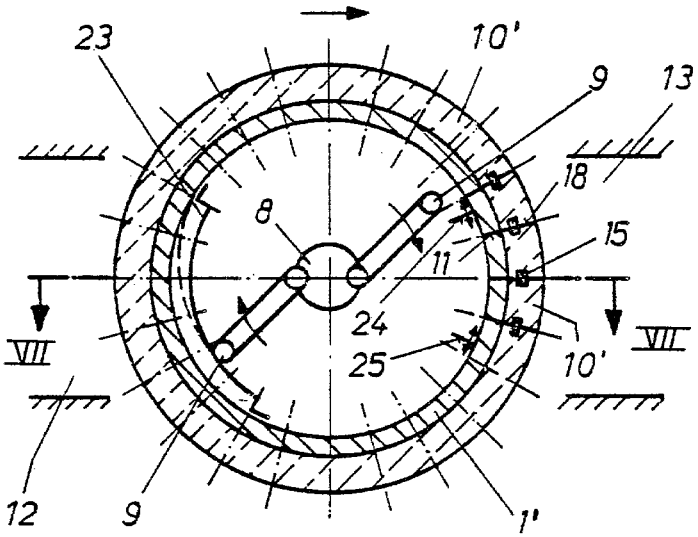
Fig. 6

Fig. 8
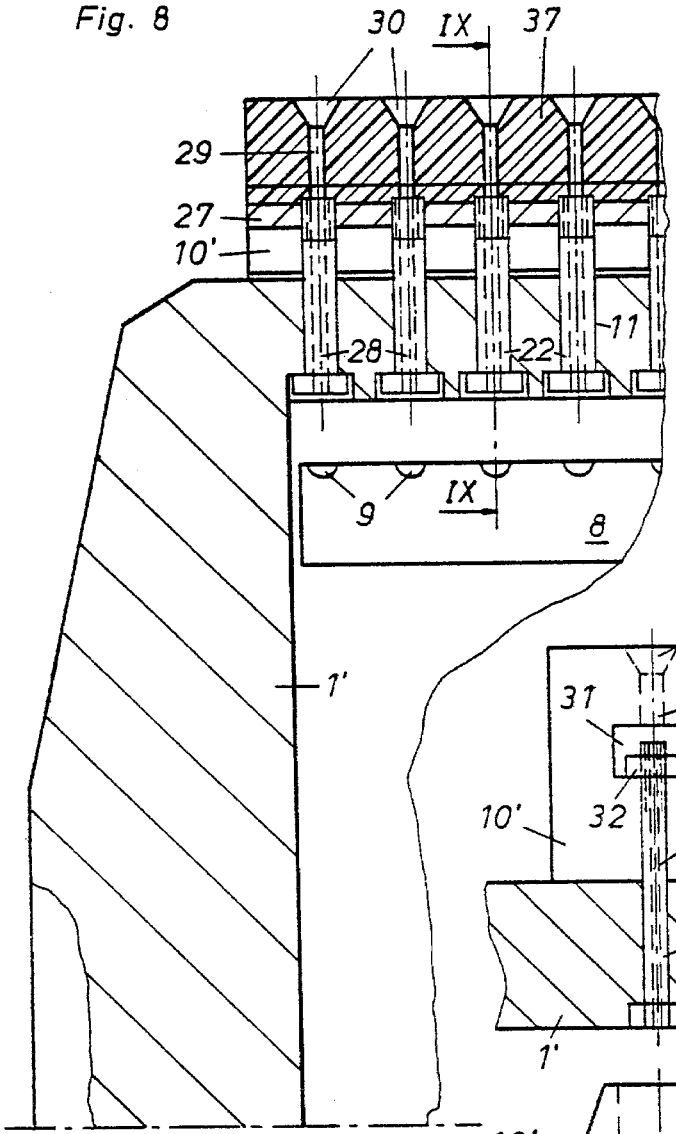
Fig. 10
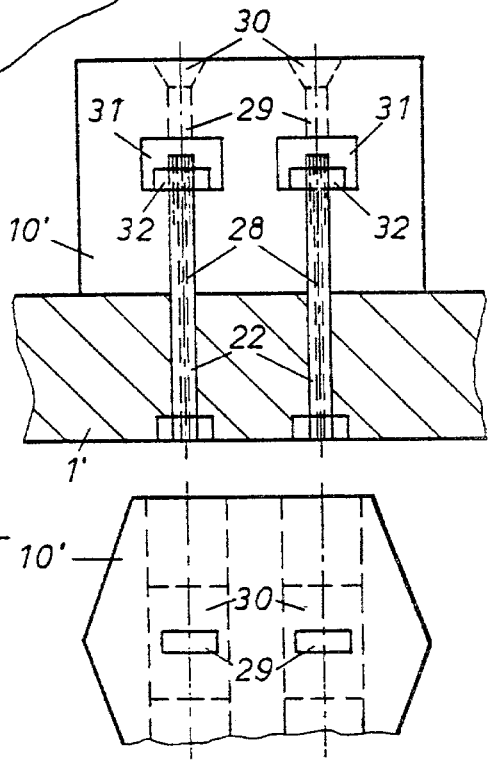
Fig. 11

29

10'
10'
26
26
27
37
22
28
1'

PROCESS AND A GRINDING STONE FOR PREPARING MECHANICAL WOOD PULP

BACKGROUND OF THE INVENTION

The invention relates to a process and to a grinding stone useful in the process for preparing mechanical wood pulp, and particularly relates to a grinding stone comprising a core and a grinding layer arranged over the periphery of this core, and wherein water is introduced into the grinding zone.

Grinding stones normally consist of an inner bearing core having a periphery on which a grinding layer in the form of grinding segments are arranged. Wood, e.g. in the form of tree trunks, pressed against the grinding layer is ground up into small fibers in the presence of an external supply of water. The supply of water not only makes the grinding possible, but it also cools the grinding stone and cleans the surface of the grinding layer. The wood fibers, mixed with water, are drawn off as pulp and are processed further. Normally, a grinding stone of this type is sprayed with water from outside directly in front of and behind the point where the wood, e.g. tree trunks, are pressed on the grinding stone under high pressure.

However, a disadvantage here is that, for example, grinding segments made of ceramic material can only take up water to a very limited extent. Besides a thin film of water on the surface, only a small amount of water penetrates into the porous ceramic material. This results in the too rapid evaporation of this water, due to the high temperatures which arise during grinding (up to around 150° C.), so that the continuous grinding process proceeds, if not completely dry, at least with a considerable shortage of water. This results in local over-heating and also in uneven pulp preparation.

SUMMARY OF THE INVENTION

The object of the present invention is to improve the supply of water to the wood grinding zone.

Another object of the invention is to supply water to the grinding zone from the interior of the grinding stone.

According to the invention, at least some of the water required is conducted from inside the grinding stone, via bores in the core, to the inner circumferential wall of the porous grinding layer, and from there, the water is carried out into the grinding zone. The water is conducted by centrifugal force through the bores in the core, which is generally impermeable to water, to the grinding layer. The grinding layer is permeable to water, e.g. it is porous itself or has bores or openings through it, through which water can permeate again by centrifugal force, to the surface. The supply of water in the vicinity of the grinding zone is thereby increased. If necessary, all of the required water for grinding can be supplied from the inside of the grinding stone. Also, with a water supply from the inside of the grinding stone, it is possible, if required, to supply water to a specific area.

Another important advantage is that, due to the centrifugal force effect, the water arrives on the surface of the grinding stone at a specific overpressure. For this reason, water at higher temperatures may be supplied to the grinding zone. This softens the lignin so that better and more even mechanical wood pulp can be obtained with reduced energy expenditure.

German Pat. No. 511 547 describes a grinder in which water is brought via a bore in the support shaft into the free inner space in the grinding stone. The purpose of this water supply is to moisten the grinding stone throughout during its operation, in order to eliminate an ostensible danger zone for stress cracking between the moistening due to the external supply of water and the inner dry zone. Obviously, the stone in this patent is a solid stone and the water is supposed to permeate through the pores. However, this effect is inadequate.

With the process according to the invention, on the other hand, it is possible, perhaps with the use of pressure as well, to conduct the necessary water right up to the grinding layer which is made porous and through which water can then readily permeate. In this way, the water can be conducted in large quantities to the external peripheral areas of the stone and can emerge there, and specific sections of the stone can be supplied with water as desired. If necessary, bores for conveying water can be provided in the grinding layer to make the grinding layer porous.

Because an uninterrupted supply of water is brought from the inside of the grinding stone into the grinding zone, an adequate amount of water is always available, so that the untimely evaporation of the water does not occur.

According to the invention, provision may also be made for pressurized water and/or compressed air to be supplied. This measure makes it possible to achieve a further rise in the temperature of the water supplied, as described above, before it boils. If the required pressurized water is supplied at temperatures above 100° C., the grinding process is enhanced for the reason discussed above. Normally, after a grinder has been stopped, a specific running-up time is necessary. But, with pre-heating with hot water, it is possible, if required, to start grinding even at full load. Again, as a result of blowing in compressed air, the water boils at higher temperatures.

According to the invention, water vapor, e.g. saturated steam may be supplied. This makes it possible to moisten the grinding layer throughout, like a sponge. An important advantage of the water or vapor supply according to the invention is that the supply can be carried out at the same energy level as that of the suspension, in order to save energy.

An embodiment of the grinding stone according to the invention has a core made of concrete with a free inner space into which one or more water supply lines open out. The core has bores running substantially in the radial direction. The bores in the concrete core supply the necessary water in a simple way. The water supply lines can supply water to certain specific areas, particularly the grinding zone and the zone following or after the grinding, to clean the grinding stone. Advantageously, in a multi-press grinder, a special water supply line will be provided for each grinding zone. A core made of other material, such as steel or plastic, may also be used instead of a concrete core.

Another embodiment of a grinding stone according to the invention is provided on its circumference with outer grinding layer bores which are in communication with the inner space of the core for conveying water. In this case, therefore, bores are provided in the grinding stone which extend directly all the way between the inner space in the core to the outer surface of the stone. Depending on the composition of the stone, these bores can be through-bores from the core through the grinding layer, stepped bores, or bores in the core and grinding layer, respectively, which are offset from each other and which are connected to each other via suitable intermediate chambers.

In this version, by the appropriate design or arrangement of one or more water supply lines, the water outflow can also be controlled. For example, water can be brought out of the bores in the grinding layer onto the surface of the stone to a greater extent in the region of the grinding zone, or possibly even exclusively in this region. For reasons of strength, technical experts have so far avoided weakening the grinding stone with bores of this kind. Due to the high level of centrifugal force and the high temperatures, combined with corresponding variations, it was generally believed that the provision of bores would entail a risk that the grinding stone would fracture. However, the inventors realized that these very bores would prevent high temperature and detrimental temperature variations, so that the danger of stone fractures is eliminated.

According to the invention, the grinding layer may be comprised of porous grinding segments made of ceramic material. It is advantageous if the grinding layer porosity comprises bores opening out in the vicinity of the gaps between the ceramic grinding segments. In another embodiment, the grinding segments are provided at their inner circumferential walls with pockets into which the water bores of the core open. From each pocket of water, water can reach the surface of the grinding stone through the grinding layer pores spaced in the ceramic grinding segments.

If required, mechanical and/or chemical purification of the water can be effected before it is supplied, so that the grinding layer bores and/or pores do not become blocked. Besides water for cleaning the stone, compressed air can also be supplied through the same bores, if required.

In a further development of the invention, the grinding segments are more porous in their inner region than in the vicinity of the grinding surface. This enables better permeation of water in the inner region, while the grinding surface presents a more solid surface.

In another feature of the invention, the grinding segments arranged over the circumference of the core have different levels of porosity. This also ensures that sufficient water is available. For supplying water in this instance, segments which have a relatively higher porosity for the permeation of water can be inserted between grinding segments with normal porosity.

The water supply means according to the invention is preferably able to direct water outwardly toward the grinding zone as the grinding zone is rotating. In one form, the water supply is stationary inside the core and constantly sprays toward the grinding zone.

In another embodiment, one water supply system according to the invention comprises a stationary control head resting tightly against one end plate of the grinding stone. Bores or lines lead from the end plate through the core to the inner circumferential walls of the grinding segments. Here, the water supply lines are rotating with the grinding stone instead of being stationary. To supply water where it is desired on the stone outer layer, according to the invention, the required water is introduced via the stationary control head into the rotating grinding stone. It is only necessary to ensure that a seal is arranged between the end plate and the control head.

In a further development of the invention, the control head covers only one annular sector of the end plate, and the bores or slits which co-act with the control head in the remaining area of the annular sector of the end plate are uncovered. This enables water to be supplied specifically to the desired area. So that the bores or slits in the end plate do not become blocked, they can be uncovered during rotation, in the part not covered by the control head.

In an advantageous embodiment of the invention, the grinding stone has, in a known way, an inner support element or core and grinding elements made up from a plurality of segments connected to the support element. Radial bores in the support element open out in the inner space and adjoin the outer casing bores in the grinding elements.

A cost saving is achieved by this. As the grinding stone is no longer constructed as a complete encasing stone, only the grinding elements need be replaced when corresponding wear has occurred. According to the invention, it should be ensured that the outer casing bores continue on through the radial bores.

According to another embodiment of the invention, provision is also made for the support element core to comprise a metal ring, and for the grinding elements to be made of a ceramic material. A very good, light weight grinding stone is obtained with this combination. In addition, the radial bores in the support element can be formed in a simple way. Steel, spheroidal graphite iron or cast steel may be used for the metal ring, for example.

It is advantageous in this instance if the grinding elements are axis-parallel segments extending over the entire length of the grinding stone, and if they are equipped with fixing grooves for attaching them to the support element. According to the invention, several segments are arranged adjacent to each other on the circumference of the support element, and thus form the grinding layer. Within the scope of the invention, it is also possible to use segments with other shapes, such as a honeycomb shape, for example.

In a further development of the invention, the fixing grooves are longitudinal grooves extending along either side of each segment substantially over the entire axial length of the segments. In the space which is formed by two grooves on abutting adjacent segments, a strip with radial, water transmitting bores is arranged, extending substantially over the whole length of the segment. Via each strip, the adjacent segments are attached to the support element by means of a screw connection. This provides a simple solution for the grinding stone according to the invention, and also makes maintenance easy.

According to a further development of this embodiment, the strip is provided with tapped radially bores in which screws are screwed from the inner casing of the support element outwardly. The screws have through-bores in them which form the radial bores for the passage of water. In addition to providing a simple attachment system for the segments on the supporting core, this also provides a simple water supply system to the outer casing bores in the grinding layer segments.

The outer casing bores in the grinding segments may be formed by gaps between the segments that are filled with packing material. Between the individual segments, there is normally a gap of several millimeters. Like the hollow space between the core or support element and the segments in the vicinity of the grooves, these gaps are filled with a packing material, such as plastic, before the grinding stone is put into use. Wooden plugs, or the like, are inserted in the gaps at the points where bores, which are in communication with the radial bores in the support element, are to be left open in the outer casing. Then the gaps are filled with packing material. After filling of the gaps and removal of the plugs, the required bores remain.

It is advantageous for the bores in the grinding layer to be widened out nozzle-fashion at their outflow point, and for the bores in adjacent grinding layer segments to be disposed offset from each other over the length of the grinding stone. This allows a great deal of water to flow out, and the surface of the grinding stone can be almost completely covered with water.

In a further development of the invention, the outflow holes from the water supply lines open out in a chamber extending substantially in the vicinity of the grinding zone over the length of the stone, and lying close against the inner casing of the core or support element. This enables pressurized water to be induced, so that a greater amount of water can be supplied and so that higher water temperatures are also possible. If this chamber is of wedge-shaped construction, viewed in cross-section, with the thin end of the wedge pointing in the running direction of the grinding stone, this also provides an additional pressure head.

Using the same principle, the outflow holes of the water supply lines may open out in the vicinity of two scrapers, extend substantially over the length of the stone. One scraper lies in the vicinity of the entrance into the grinding zone. The other scraper lies in the vicinity of the exit from the grinding zone. The blade angle of the scrapers relative to the inner casing of the support element are preferably adjustable so that the level of the pressure head can be adjusted.

Furthermore, it is advantageous if the water supply lines with the outflow holes inside the grinding stone can be displaced in the circumferential direction. In this way, the water supply can be controlled as desired. For example, besides the water supply supplying water to the grinding stone, supplementary cleaning of the surface of the stone can be effected.

Other objects and features of the invention will be apparent from the following description of preferred embodiments, considered with reference to the accompanying drawings.

BRIEF DESCRIPTION OF THE DRAWINGS

FIG. 6 is a cross-sectional view through another embodiment of a grinding stone with a steel ring as the core or bearing element.

FIG. 7 is a longitudinal sectional view along the line VII—VII in FIG. 6.

FIG. 8 is an enlarged detail in section of the attachment system of the grinding element on the bearing element.

FIG. 10 is a detail in section of an attachment system for a honeycomb-type grinding element.

FIG. 11 is a plan view of a fragment of the grinding element of FIG. 10.

DESCRIPTION OF THE PREFERRED EMBODIMENTS

Figure 1:
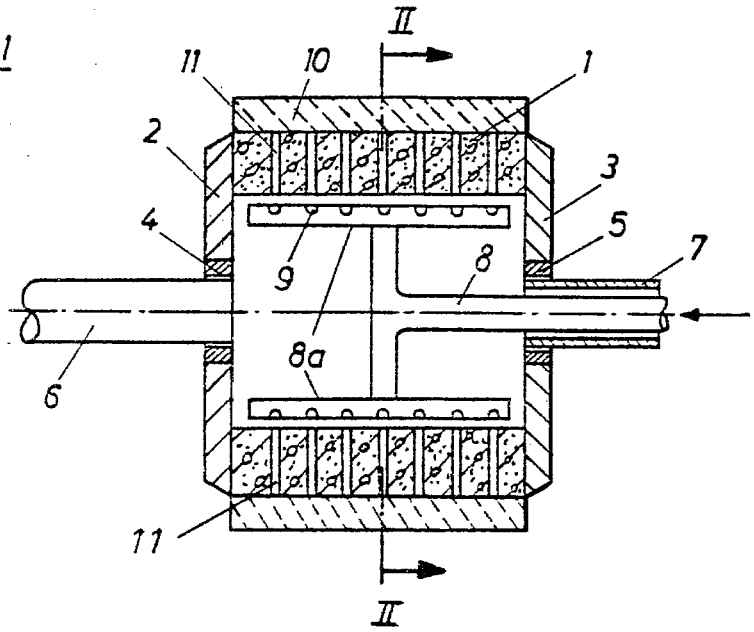
FIG. 1 is a longitudinal sectional view through a grinding stone with a concrete core, along the line I—I in FIG. 2.

A first embodiment of a grinding stone according to the invention is shown in FIGS. 1 to 5. It includes an annular, hollow concrete core 1 as its bearing element. The covers 2 and 3 of steel are placed on the ends of the core. The two covers 2 and 3 are connected by respective tapped bushes 4 and 5 of the respective shafts 6 and 7. The grinding stone is rotatable on its shafts 6 and 7.

The shaft 7 has a bore through it which receives a water supply line 8 in it. The line 8 leads to conduits 8*a*, and water outflow holes 9 are arrayed longitudinally along the conduits 8*a*. The line 8 and conduits 8*a* remain stationary as the grinding stone rotates. The conduits are positioned at the grinding zone, as described below.

A plurality of longitudinally extending grinding segments 10 made of ceramic material, extending the axial length of the core 1 and each defining a segment of an annulus, are attached in a known way to the exterior of the core 1.

Figure 2:
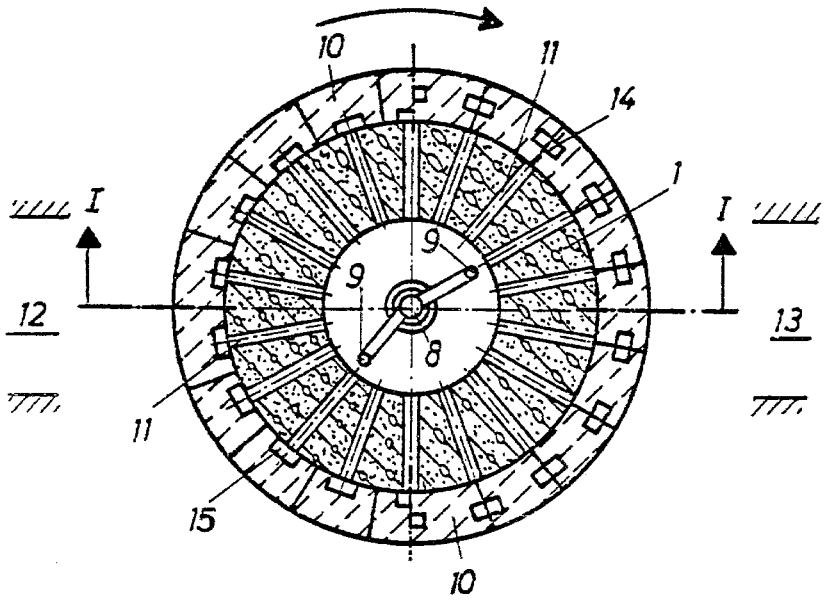
FIG. 2 is a cross-sectional view through the grinding stone of FIG. 1, along the line II—II in FIG. 1.

The concrete core 1 is provided with a multiplicity of radially extending bores 11, arrayed along its length (FIG. 1) and around its circumference (FIG. 2).

The drawings show a two-press grinder with two pressing or grinding zones 12 and 13 at opposite sides of the roller. Accordingly, the water supply line 8 branches into two corresponding branches so that water emerges via the outflow holes 9 at the start of each grinding zone.

FIG. 2 illustrates two possibilities for an arrangement of the bores 11. In the right-hand half of FIG. 2, the bores 11 and grinding segments 10 are arranged and placed so that the bores 11 terminate in the vicinity of the radial gaps between the grinding segments 10. In the gap area, the grinding segments 10 are normally provided with recesses 14 via which they are attached to the concrete core 1. The recesses 14 can form a reservoir for the water sprayed through the bores 11, before the water arrives, due to the porosity of the grinding segments 10, at the surface of the grinding stone under the effect of centrifugal force.

In the left-hand half of FIG. 2, the bores 11 are arranged to emit water radially inside the segments 10, not at gaps between the segments. The grinding segments are provided with pockets 15 on their inner circumferential walls, and the bores 11 open in the vicinity of the pockets 15. Water pockets are formed, which due to the porosity of the grinding segments, enables water to reach the surface of the grinding stone.

Figure 3:
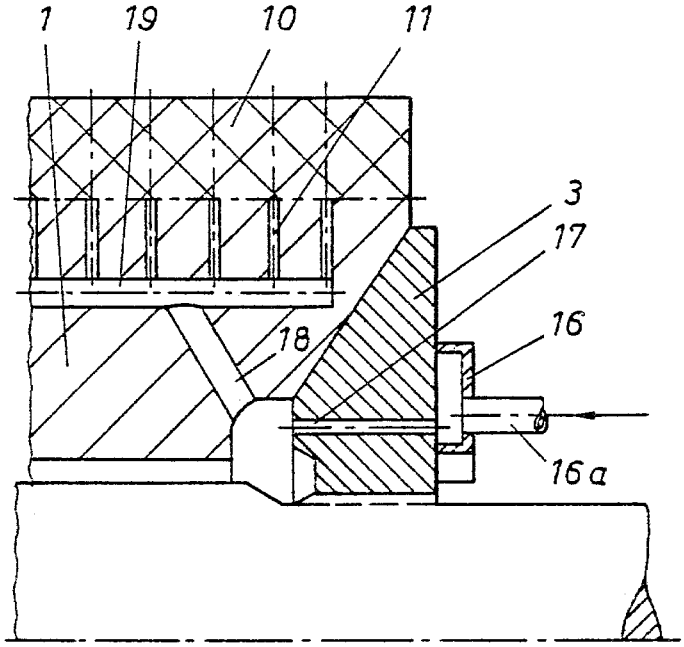
FIG. 3 is a cross-sectional view of a fragment of an embodiment of a grinding stone with a control head.

In FIG. 3, the grinding stone has a control head 16. The control head 16 is arranged stationary and nonrotatably on a support (not shown) while the grinding stone and its shaft rotate. The control head lies tightly against the end plate 3 of the grinding stone. To supply water to a specific area, the control head is arranged only on one annular sector of the end plate 3. This annular sector is located in the region of, or immediately in front of, or upstream in the rotation of the stone, of the grinding zone of the stone. The end plate 3 has a series of eccentric, axially extending bores 17 arrayed annularly around its axis. Only one bore 17 is shown.

The bores 17 communicate to respective oblique bores 18. In order that the bores 17 in the end plate 3 not become blocked, they are uncovered outside the control head 16. Water enters the hollow chamber of the control head 16 through the conduit 16*a* and the water is sprayed from the control head 16 into the eccentric bores 17 as they sweep by in front of the eccentrically positioned control head. From the bores 17, the water passes via oblique bores 18 into axial bores 19 or pipelines formed in the core 1 and which extend over the entire axial length of the grinding stone. Water leaves bores 19 through the radial bores 11 which open out in the vicinity of the inner circumferential walls of the grinding segments 10. The axial bores 19 can also be arranged in the dividing zone between the grinding segments 10 and the core 1. In this case, it may be sufficient merely to provide grooves extending appropriately over the axial length of the core, instead of pipelines or bores 19. Here the water flow lines rotate with the grinding stone, in contrast with the first embodiment. But, the control head activates those water supply bores feeding the grinding zone, whereby here, too, only the grinding zone is supplied with water.

Figure 4:
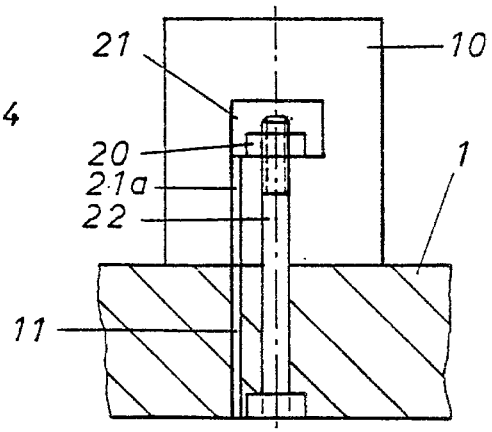
FIG. 4 is an enlarged detail in section of a grinding segment of a grinding stone.
Figure 5:
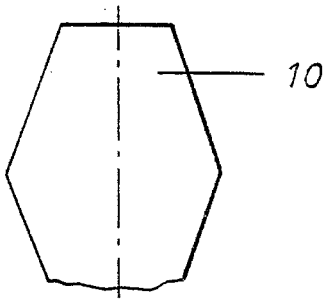
FIG. 5 is a plan view of the grinding segment shown in FIG. 4.

An enlarged section of another embodiment of a grinding segment is shown in FIGS. 4 and 5. Instead of extending the length of the core 1, these segements are honeycomb shaped, whereby the core would be covered by a matrix of segments. As can be seen in FIG. 4, the grinding segments are fixed on the concrete core 1 by screws. One possible attachment system comprises a through screw 22 that is held in the core 1 and that has a threaded shank that projects out of the core, and through a bore in the grinding segment into a hole or pocket 21 inside the segment. A nut 20 inside the pocket 21 and resting against a shoulder of the segment 10 is tightened on the screw 22. Alternatively, a screw, like screw 22, may be screwed in a thread defined in the grinding segment 10. After the grinding segment 10 has been attached to the core 1, the hollow spaces between grinding segments can be filled in with a plastic material, or the like.

The water bores 11 in the core 1 can be aligned with and thus extended by the bores 21*a* in the segments 10, and the bores 21*a* lead out to the pockets or holes 21 for the nuts 20. This makes the conveying of water to the segments 10 easier.

FIGS. 6–11 show a grinding stone with a steel ring 1 for the bearing element or core. Corresponding features to those in the embodiment of FIGS. 1 to 5, are identified with corresponding reference numerals.

The grinding stone has a steel ring 1' as the support or bearing element. The steel ring also defines one end cover for the grinding stone. At the other end, the grinding stone has an end cover 2'. However, if required, two end covers, one at each end, may also be provided. Around the circumference of the steel ring 1', a plurality of grinding element segments 10' are arranged. For the sake of clarity, the segments 10' in FIG. 6 are shown schematically. Again, a two-press grinder with two pressing zones 12 and 13 is shown. A two duct water supply line 8 leads via a central bore in the cover 2' into a clear inner space formed inside the hollow steel ring 1' in the grinding stone. The water supply line 8 terminates in the vicinity of the inner circumferential wall of the steel ring 1'. Water is sprayed via outflow holes 9 onto the interior of the inner circumferential wall specifically in the vicinity of the grinding zones 12 and 13. Since the supply line 8 has two ducts 8*a* and 8*b*, the two grinding zones 4 and 5 can be supplied with water independently of each other. The water can either be sprayed out of the outflow holes 9 freely onto the circumferential wall. Alternatively, supplementary means for increasing the pressure may be provided, as shown in FIG. 6. As can be seen in FIG. 6, the two-duct water supply line 8 can be swivelled so that the water supply can be positioned.

In the left-hand half of FIG. 6, a chamber 23 is shown, which extends substantially over the entire axial length of the grinding stone. At its lower and upper ends, the chamber 23 lies against the inner circumferential wall of the steel ring 1'. Sealing can be achieved by means of a labyrinth seal, for example. A pressure head is established in the chamber 23. With this arrangement water can be introduced into the radial bores 11 in the steel ring at an overpressure. The pressurizing effect is further enhanced if the chamber 23 is of wedge-shaped construction, as shown in dashed lines in FIG. 6 with the thin end of the wedge pointing in the running or downstream direction of the rotating grinding stone.

In the right-hand half of FIG. 6, an alternate technique of pressurizing of the water by means of scrapers 24 and 25 is shown. The water supply line in this case can terminate with its outflow holes 9 above the upstream scraper 24. The water is drawn in via a gap between the scraper 24 and the circumferential wall of the steel ring 1'. Alternatively, the outflow holes may terminate between the two scrapers. The blade angle of the two scrapers can be adjusted to control the pressurizing. The chamber 23 or the scrapers 24 and 25 can obviously also be used in the embodiment according to FIGS. 1 to 5.

Figure 9:
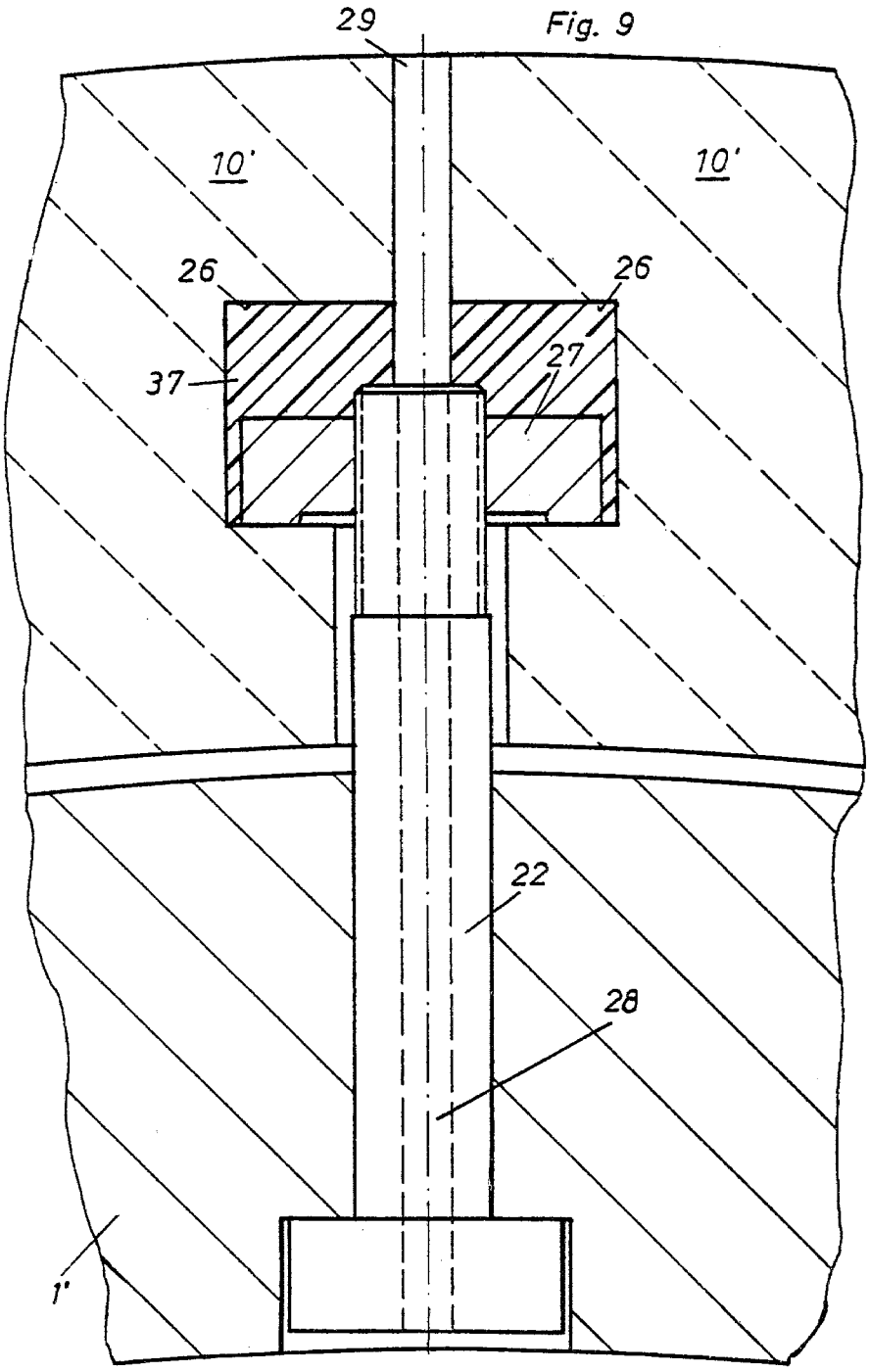
FIG. 9 is an enlarged detail in section, along the line IX—IX in FIG. 8.

An attachment system for the axially elongated grinding segments 10' is shown in FIGS. 8 and 9. These segments are unlike the honeycomb-shaped elements of FIGS. 4 and 5. The segments 10' extend the entire axial length of the grinding stone (see also FIG. 7). The steel ring 1' has a multiplicity of radial bores 11 in which screws 22 are disposed. The segments 10' are equipped on either axially extending side wall with fixing grooves 26, which extend axially over the entire axial length of the segments 10'. In the space which is created between two adjoining grooves on adjacent segments 10', a strip 27 is arranged. It also extends over the entire axial length of the grinding stone. The strip 27 is equipped with tapped bores which line up with the radial bores 11 in the steel ring 1'. Screws 22 are pushed from the inside of the steel ring 1' through the bores 11 and are screwed into the tapped bores in the strip 27. In this way, the separate segments 10' are securely attached to the steel ring 1' and each can be replaced in a simple way when it becomes worn. The screws 22 may have through bores 28, which ease passage of water through the steel ring 1' to the grinding segments.

Since there is a gap between each of the segments 10' when they are mounted, this gap is used for producing the outer casing bores 29. After the segments 10' have been mounted on the steel ring 1', the hollow spaces are filled with a packing material 37, generally plastic. The gaps between the segments 10' are also filled in this way. By inserting pieces of wood, or the like, in the gaps before the plastic is sprayed or poured, the outer casing bores 29 are produced because the areas with the wood pieces are left clear. After the pieces of wood are removed, the outer casing bores 29 remain. As can be seen particularly clearly from FIGS. 8 and 9, the outer casing bores 29 are connected with the outflow holes 9 in the water supply line 8 in the inner space inside ring 1'. Naturally, however, it is also possible to form the outer casing bores 29 specially, separately in the segments 10', instead of forming them in the existing gaps. A very good film of water is created on the surface of the segments 10' if the outer casing bores 29 are arranged offset from each other in two adjacent rows over the length of the grinding stone.

As can be seen in FIG. 8, the outer casing bores 29 are provided in their outflow zone with sections 30 which widen out nozzle-fashion.

Instead of providing screws 22 with throughbores 28, within the scope of the invention, any other type of screw connection can be used. These connections may also be used in the embodiments of FIGS. 1 to 5, or with honeycomb-type grinding segments. However, it is necessary to ensure that there are radial bores 11 in the steel ring 1' through which the water can pass. In the same way, the outer casing bores 29 in the grinding segments must be arranged so that they are in communication with the radial bores 11 in the steel ring 1'. FIGS. 10 and 11 show a honeycomb-type grinding element 10', which is arranged in honeycomb formation on the external circumference of the support element, i.e. the steel ring 1'. For attachment of segments 10', they are equipped with one or (as shown) two holes 31. In each of these, a nut 32 is positioned, which is connected to a screw 22. The screws which are seated in the support element 1' can also be equipped with a through-bore 28 for water passage.

In any of the embodiments, the grinding layer 10 or the segments 10' thereof may be designed so that when porous material is used, the grinding layer is more porous at the region closer to the core than at the region closer to the peripheral grinding surface thereof. This assures good water transmission and also grinding ability of the grinding layer.

Although preferred embodiments of this invention have been described, many variations and modifications will now be apparent to those skilled in the art. It is therefore preferred that the instant invention be limited not by the specific disclosure herein, but only by the appended claims.

What is claimed is:

1. A rotatable grinding stone for preparing wood pulp, said grinding stone comprising:

an annular rotatable core with an interior for defining a free inner space;

a grinding layer around said core for grinding wood into pulp, said core and said grinding layer being adapted to transmit water through themselves;

a water supply line in and extending axially along said free inner space, and said water supply line having outlet openings for discharging into said free inner space;

pressure increasing means being defined at said core interior for locally increasing the water pressure at said core interior at said pressure increasing means, thereby to urge transmission of water out through said core and said grinding layer.

2. The grinding stone of claim 1, wherein said outlet openings of said water supply line discharge into the region of said pressure increasing means.

3. The grinding stone of claim 2, wherein said grinding layer has a grinding zone, which is fixed in location as said core and grinding layer rotate, at which wood is ground, and said pressure increasing means being located at said grinding zone.

4. The grinding stone of any of claims 1, 2 or 3, wherein said pressure increasing means comprises a chamber defined in said free inner space at said interior of said core, and said chamber extends along the axial length of said core; said chamber being held stationary as said core rotates by said chamber.

5. The grinding stone of claim 4, wherein said chamber is generally liquid sealed against said interior of said core.

6. The grinding stone of claim 5, wherein said outlet openings of said water supply line discharge into said chamber.

7. The grinding stone of claim 6, wherein said water supply line outlet openings are displaceable circumferentially with respect to said core.

8. The grinding stone of claim 4, wherein said outlet openings of said water supply line discharge into said chamber.

9. The grinding stone of claim 8, wherein said water supply line outlet openings are displaceable circumferentially with respect to said core.

10. The grinding stone of claim 4, wherein said chamber is defined by walls above said interior of said core, and said chamber walls are shaped with respect to said core interior so as to give said chamber a narrowing cross-section in the direction of rotation of said core.

11. The grinding stone of claim 4, wherein said chamber is defined by walls above said interior of said core, and said chamber walls are shaped with respect to said core interior so as to give said chamber a wedge shape, tapering narrower and spaced less distant from said core interior in the direction of rotation of said core.

12. The grinding stone of any of claims 1, 2 or 3, wherein said pressure increasing means comprises two scrapers positioned at said interior of said core and being held stationary there with respect to rotation of said core; said outlet openings terminate in the vicinity of said two scrapers; said scrapers extend longitudinally over the axial length of said grinding stones; said scrapers being spaced apart around said core, with one said scraper being placed in the vicinity of the entrance to the wood grinding zone of the grinding stone and with the other said scraper being placed in the vicinity of the exit from the grinding zone of said grinding stone.

13. The grinding stone of claim 12, wherein said scrapers each comprise a blade extending toward said interior of said core, and the angle of each said blade with respect to said interior of said core being adjustable.

14. The grinding stone of claim 2, wherein said water supply line outlet openings are displaceable circumferentially with respect to said core.

15. A rotatable grinding stone for preparing wood pulp, the grinding stone comprising:

an annular rotatable core with an interior for defining a free inner space;

a grinding layer separate from said core and disposed around said core for grinding wood into pulp; said grinding layer comprising a plurality of individual segments;

fastening screws extending radially for fastening said segments to said core; a respective bore being provided through each said screw for the passage of liquid through said screws;

a liquid feed device inside said core interior, and said screw bores communicating therewith; said screw bores also communicating with said grinding layer for delivering liquid thereto.

16. The grinding stone of claim 15, wherein radially extending bores are defined in said grinding layer and said screw bores communicate with those said radially extending bores for delivering liquid thereto.

17. The grinding stone of claim 15, wherein said grinding segments extend over the entire axial length of said core and are arrayed side-by-side.

18. The grinding stone of claim 17, wherein adjacent said segments have opposed sides facing toward each other; fixing grooves are defined in said opposed sides of adjacent said segments, and said segments are attached to said core at said fixing grooves.

19. The grinding stone of claim 18, wherein said fastening screws are connected to said fixing grooves for attaching said segments to said core.

20. The grinding stone of claim 19, wherein said fixing grooves extend longitudinally over substantially the entire axial length of said segments;

a respective elongate strip extending between and being positioned in both said fixing grooves in the adjacent opposed said sides of adjacent said segments; radially extending bores being defined at spaced intervals along said strip a said fastening screw being connected to said segments by passing through a respective said bore in said strip and engaging that said strip and tightening of said fastening screw drawing said segments and said core together.

21. The grinding stone of claim 18, wherein said strip bores are threaded and said fastening screws are correspondingly threaded such that said screws are screwed into said strip bores.

22. A rotatable grinding stone for preparing wood pulp, the grinding stone comprising:

an annular rotatable core with an interior for defining a free inner space;

a grinding layer separate from said core and disposed around said core for grinding wood into pulp; said grinding layer comprising a plurality of individual segments;

fastening means securing said segments to said core;

a liquid feed device at said core, and said core being adapted to permit liquid to travel to the interior of said grinding layer segments; said grinding layer being porous, and water transmitting; said grinding layer segments being more porous at the region thereof closer to said core than in the region thereof at the grinding periphery thereof.

23. A rotatable grinding stone for preparing wood pulp, the grinding stone comprising:

an annular rotatable core with an interior for defining a free inner space;

a grinding layer separate from said core and disposed around said core for grinding wood into pulp; said grinding layer comprising a plurality of individual segments;

fastening means securing said segments to said core;

a liquid feed device at said core, and said core being adapted to permit liquid to travel to the interior of said grinding layer segments; said grinding layer being porous and water transmitting; different said segments having different levels of porosity.

24. The grinding stone of any of claims 22 or 23 wherein said grinding segments extend over the entire axial length of said core and are arrayed side-by-side.

25. The grinding stone of either of claim 22 or 23, wherein said fastening means comprise fastening screws extending between said core and said segments.

* * * * *